US005746038A

United States Patent [19]

Houk

[11] Patent Number: 5,746,038

[45] Date of Patent: May 5, 1998

[54] CONSTRUCTION COMPONENTS AND ASSEMBLY SYSTEM

[76] Inventor: Edward E. Houk, 6106 Townhill, San Antonio, Tex. 78238-5033

[21] Appl. No.: 430,806

[22] Filed: Apr. 26, 1995

[51] Int. Cl.[6] ..... F04B 1/38

[52] U.S. Cl. ..... 52/590.1; 52/590.2; 52/592.2; 52/721.4; 52/284; 446/116; 446/125

[58] Field of Search ..... 52/590.1, 590.2, 52/591.1, 591.2, 592.1, 608–609, 592.3, 721.4; 446/108, 109, 111, 112, 116, 478, 125; 248/345.1

[56] References Cited

U.S. PATENT DOCUMENTS

| | | | |
|---|---|---|---|
| 1,345,156 | 6/1920 | Flynn | 52/590.2 X |
| 2,691,242 | 12/1954 | Young | 52/590.2 X |
| 2,882,714 | 4/1959 | Gagle et al. | 52/590.1 X |
| 3,670,449 | 6/1972 | Lemkin et al. | 446/125 X |
| 3,701,214 | 10/1972 | Sakamoto | 446/116 X |
| 4,090,883 | 5/1978 | Rawschenfels | 106/99 |
| 4,689,084 | 8/1987 | Ambroise et al. | 106/99 |
| 4,909,718 | 3/1990 | Payne . | |
| 5,006,386 | 4/1991 | Menichini | 248/345.1 X |
| 5,118,547 | 6/1992 | Chen | 428/44 |
| 5,170,550 | 12/1992 | Cox et al. | 52/630 X |
| 5,212,842 | 5/1993 | Glydon | 446/116 X |

*Primary Examiner*—Carl D. Friedman
*Assistant Examiner*—Winnie S. Yip

[57] ABSTRACT

Assembled structural components, fabricated from cementitious, fibrous, clay, and aggregate materials, have fibers aligned parallel to tensile forces to form a load bearing structure for use in construction. Fiber and cement membrane components hold rigid core parts in the same relationships as membrane components hold organs in animals. These parts force membrane components apart at selected places to tension and protect membrane components from compressive forces. Facing units are interlocked with membrane faces in parallel alignments. A system of ventilating holes and openings prevents damage due to heat. In groups of three membrane components, a row of thickened, tapered projections, of truncated pyramid shapes extending from an edge, interlock with strikes on faces of two interconnected membrane components in perpendicular alignment to the first, to make rigid corners within polyhedron shaped trusses within a whole, structurally continuous, interlocked, load bearing, assembled structure of components which cannot be detached by outside forces.

4 Claims, 11 Drawing Sheets

108
106
107
104
102
103
101
109
105
110
111

103
108
105
109
107
104
102
103
110

101
102
104
106
104
103
110
104
103
108
105
109
107
111
110

201
202
203
204
205
108
102
105
109
215
102
103
101
111
110
206
207
103

216
207
103
210
101
102

515
102
806
505
515
806
103
104
214
206
213
103

103
208
209
211

23
501
502
501
514
515
102
503
508
508
516

5\19
504
505
506
507
508

506
102
501
510
511
501
503
509

511
508
102
512
508
511

517
517
518
518

501
510
502
508
508
512

31
701

705
101
703
704
710
703
101
706
704
111

705
101
710
708
705
111
709
708

709
34
705
111
708
707

705

FIG. 35
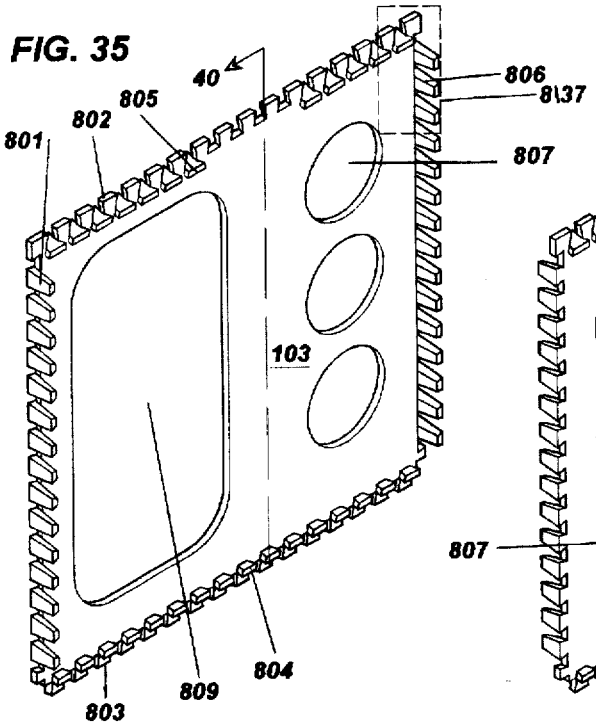
FIG. 36
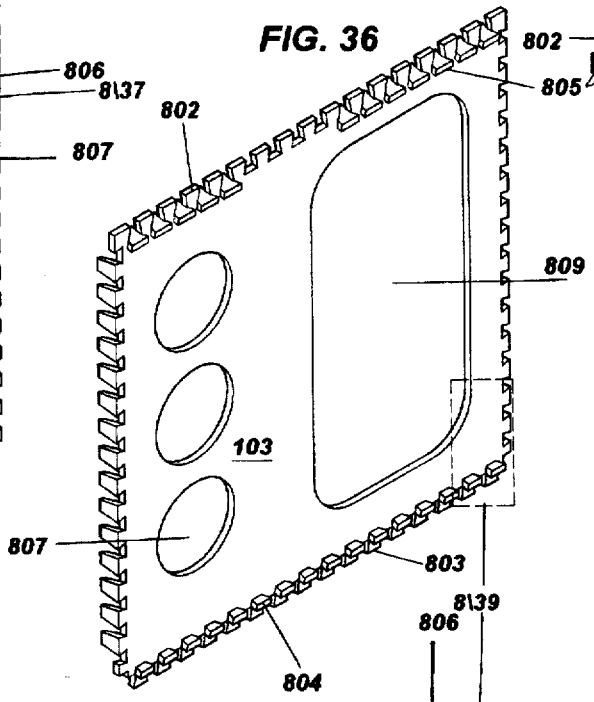
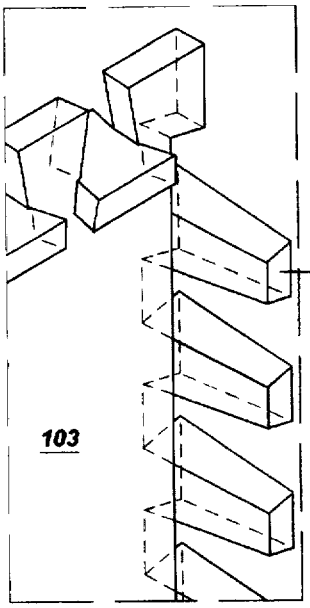
FIG. 37
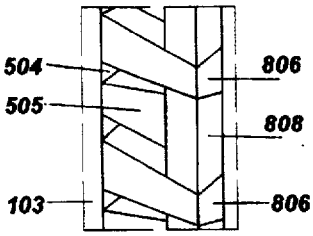
FIG. 38
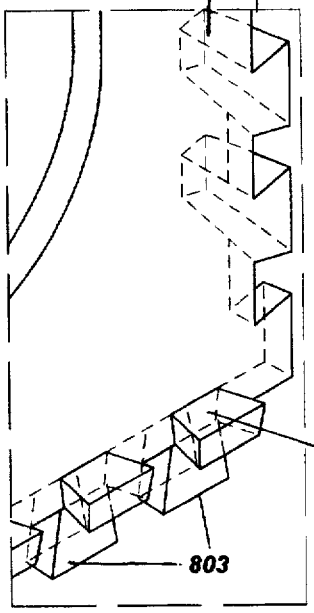
FIG. 39
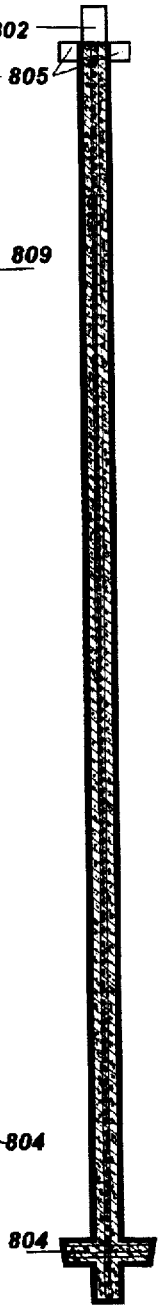
FIG. 40

FIG. 41
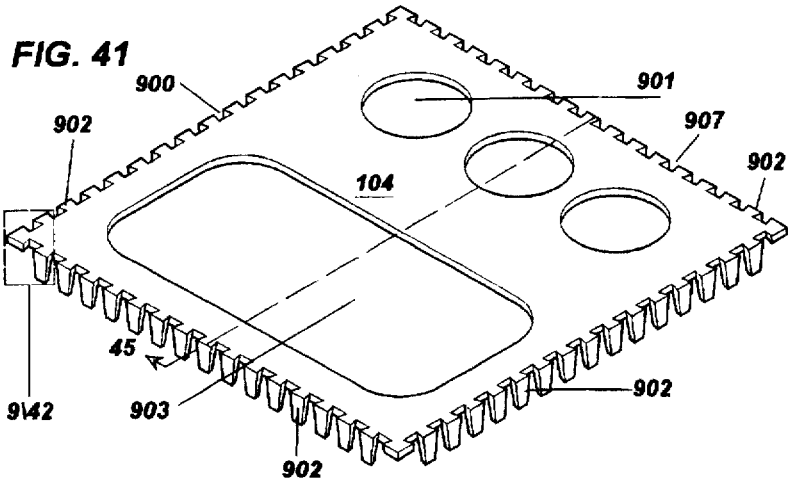
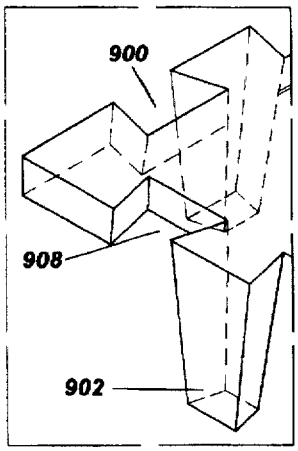
FIG. 42
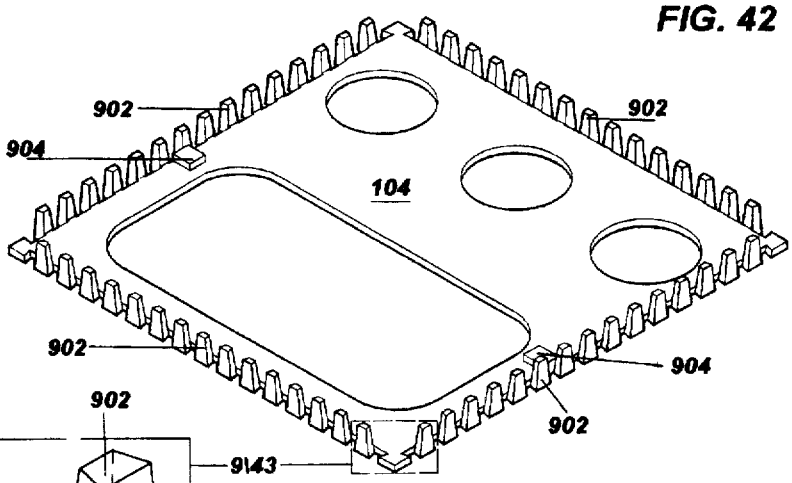
FIG. 44
FIG. 43
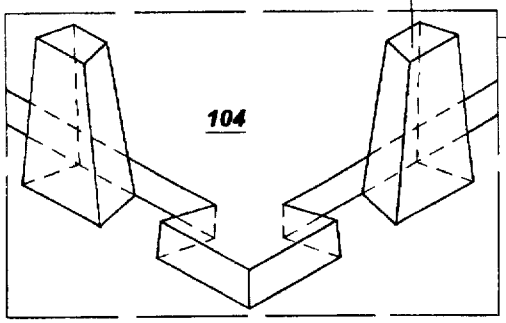
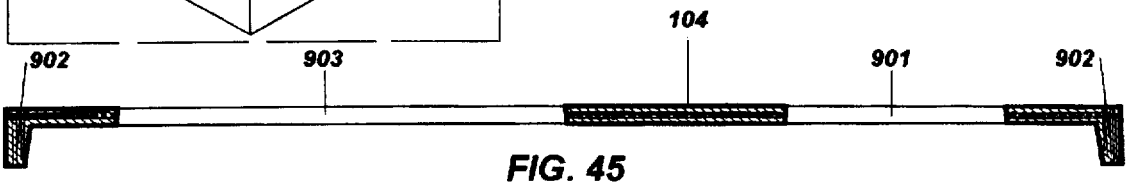
FIG. 45

CONSTRUCTION COMPONENTS AND ASSEMBLY SYSTEM

CROSS-REFERENCES TO RELATED APPLICATIONS

This invention is related to U.S. Pat. No. 5,628,955, Method of Manufacture of Structural Products, issued May 13, 1997 and hereby made a part of this specification.

State and local building and construction codes differ; but all have common elements based on steel, concrete, and wood construction since fibrous structural products have not been widely accepted. Moreover, insurance rates preclude the use of fibrous resinous materials in most structures because of fire hazards. Some glass fibers have failed due to caustic action of incompatible constituents, resulting in loss of confidence in use of glass fibers in hydraulic cements. New construction products must be consistent with local codes, insurance criteria and rigid testing before universal commercial application would be practical.

Fiber reinforced sun dried bricks were used by the oldest civilizations. Although the superior tensile strength of inorganic and organic fibers has been recognized for over 40 years, widespread application has been limited to aircraft, boats, underground vessels, roofing materials and plasters because of the before mentioned difficulties.

Casting, pressure molding and extruding have long been necessary for forming cementitious products. Very small tolerance is not possible using these methods without loss of other desirable attributes. Without sufficient plasticity, voids within the product result and an acceptable finish can not be accomplished with today's molding, casting and extrusion technology. Use of flammable resinous materials is not a viable alternative unless an insulated, fire resistant cover is applied which results in bonding problems.

Reduction in strength and loss of accuracy in dimension resulting from excess moisture or molding pressure can be overcome by use of electrical and magnetic fields in the shaping stage. An acceptable finish, fiber reinforcement alignment and a dimensionally accurate, stable and strong product can be accomplished with nonplastic cementitious matrix materials by use of electrical and magnetic fields. Use of this technology has been included in this disclosure by reference.

Materials used for the various components of this invention will be selected from available commercial products. Selection of specific materials must be flexible to adjust for market conditions and availability of new fiber products. Many high strength fibers are damaged by caustic cements. The alkalinity of the cement must be within the acceptable range for the fiber and bonding between the fiber and the cement must occur. These characteristics will be referred to as compatibility. Mechanical as well as chemical damage must be avoided. Shipping costs preclude the use of low and medium strength materials; material strength will be more fully utilized by subjecting those materials to the forces which they are most suited, such as igneous rock in compression, and fibers in tension, avoiding shear stresses across fibers. Members of this patent are structurally specialized to react to specific anticipated forces and conditions. A disclosure of material selection method follows:

Materials are listed by generic nomenclature; since commercially available products differ in physical characteristics, each product must be tested to ensure alkalinity and bonding compatibility with other products. Although one fibrous cementitious material may be selected for initial production of fire protected construction, two other classes should follow for ordinary and fire resistive construction. Therefore, this invention includes materials of all construction classes.

Cementitious materials in particulate form include hydraulic cements such as low alkalinity Portland, pozzolana, and calcium aluminate cements; resinous cements such as heat, moisture and catalytic curing cements, fireclays, kaolin, low alumina clays, gypsum; aggregate materials included with cementitious materials in compression members will include basalt, volcanic, other igneous, terra-cotta, and hard clay materials. Resinous cementitious material shall be enclosed in hydraulic cementitious or gypsum covers.

Filaments included with fibers will include barium, carbon, alkaline resistant glass, zirconium silicate glass, graphite, hydrocarbon, polypropylene, metallic, natural fibers.

Rigid insulation includes foam materials from silica, volcanic magma, factory slag, ceramic clay; it also includes loose organic and nonorganic expanded materials contained within a cementitious material pictured in FIG. 49.

SUMMARY OF THE INVENTION

Load bearing structures for use in construction are assembled using members which have fibers aligned parallel to tensile forces and are fabricated from cementitious, fibrous, clay, and aggregate materials. Fiber and cement membranes hold rigid core parts in the same relationships as membranes hold organs in animals. These parts force membranes apart at selected places to tension and protect membranes from compressive forces. Facing units are interlocked with membrane faces in parallel alignments. A system of ventilating holes and openings prevents damage due to heat. In groups of three membranes, a row of thickened, tapered projections, of truncated pyramid shapes, on a membrane edge, interlock with strikes on faces of two interconnected membranes in perpendicular alignment to the first, to make rigid corners within polyhedron shaped trusses within a whole, structurally continuous, interlocked, load bearing, assembled structure of members which cannot be detached by outside forces; and which is unique.

BRIEF DESCRIPTION OF THE DRAWINGS

FIG. 29 has been rotated 180°.

FIG. 35 is a frontal views of a first transverse, truss web member 103, a tensile membrane with teeth for interlocking with two top chord membranes and two bottom chord membranes.

FIG. 36 shows its backside where the view in FIG. 35 has been rotated 180°.

FIG. 37 details a corner from the truss member shown in FIG. 35.

FIG. 38 details a part of an assembled corner at the connection of part 103 with two joining top chord membranes 102 and preventing detachment of the assembly.

FIG. 39 details a corner from FIG. 36.

FIG. 40 is a sectional view of this truss member showing fiber reinforcement alignment and teeth on edge of each primary face and transverse faces.

FIG. 41 is a view of a second transverse, truss web member 104 illustrating a means for rigidly interconnecting chord and web membranes and preventing detachment of the members when assembled.

FIG. 42 details one corner from FIG. 41.

FIG. 43 details one corner of the same part when rotated 180°.

FIG. 44 shows the entire part when rotated in the same manner.

FIG. 45 is a sectional view of this member of the second web member with double locking teeth for rigidly interconnecting top and bottom chord and first transverse web membranes. Fiber alignment is illustrated.

DESCRIPTION OF THE PREFERRED EMBODIMENTS

Figures 1, 2, 3:
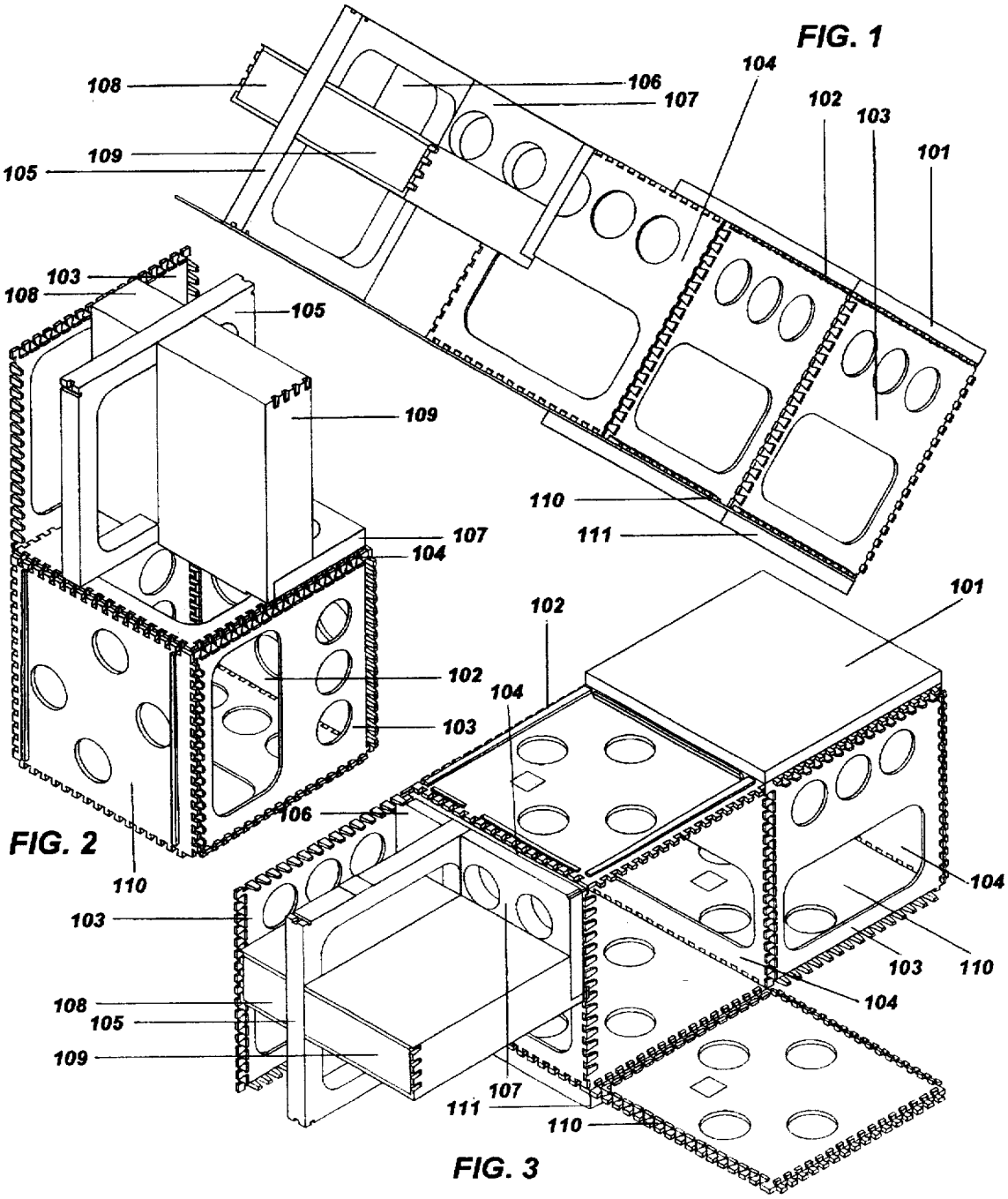
FIG. 1 illustrates the use of field shapes (not including end units or special shapes) in sloped roof systems. All views and illustrations contained herein are exploded views from the interior of the structure necessary to show interlocking parts as well as hidden core parts.
FIG. 2 is a view of perimeter field shapes.
FIG. 3 is a view of an interior floor system.

Sheets One and Two of the drawings provide exploded views to illustrate complex arrangements of the various components. All views are from the interior of the structure. This invention requires four tension resistant membrane shapes: two parallel longitudinal chord membranes, parts 102 and 110, along with two transverse web membranes, parts 103 and 104. Four web membranes and two chord membranes form a box truss. Transverse web membranes 103 and 104 must always be perpendicular to each other as well as to chord membranes 102 and 110. Longitudinal membranes may be horizontal, vertical, or sloped, but they must always be parallel.

Parts 102, 103, 104, and 110 are referred to as membranes as they act as tensile membranes holding core members in the same relationship as membranes hold organs in animals. Moreover, since they are very thin in comparison to their length (having a length to thickness ratio in excess of 40), they are very flexible and can readily be deformed. Edges must be held securely to prevent detachment.

The integrally formed connectors, referred to as bolts, tapered projections, teeth, reentrant spaces, and strikes, must be capable of transferring tensile stresses from one part into the adjoining part. Since fibers offer little or no resistance to shear and compression, tension members and connectors should not be subject to compression, or shear. Joints and edges must be rigid in order for each to act as a continuous membrane. Failure should occur only when the stress exceeds the capabilities of a membrane rather than connectors. Under these conditions assembled membranes may be structurally analyzed and designed as continuous membranes. In order for fibers to be effective tension resistors, they must be aligned parallel to the tensile stress. This is accomplished by the aforementioned means. Core members, 105 through 109, are inserted to increase rigidity and to enhance structural characteristics. They are further detailed and described hereafter.

In Figures One, Two and Three structural membranes, 102, 103, 104 and 110, are shown in groupings; while anti-compression, shear, and rotation members, 105 through 109, are shown in other groups. Since parts 105 through 109 are always hidden inside the structural membranes, explosive views are necessary. A key member to separation of tension forces from other forces is part 105. It forces the longitudinal membranes apart at the point of inflection, where stresses normally change in a continuous membrane, and forces tensile stresses in both longitudinal (chord) as well as transverse (web) membranes. It transfers live loads from part 101 to part 111, thereby protecting intermediate parts from compressive forces. Since members 102, 103, 104, and 110 are purely tension members, full advantage can be made of the high tensile properties of fibers.

Figures 4, 5, 6, 7:
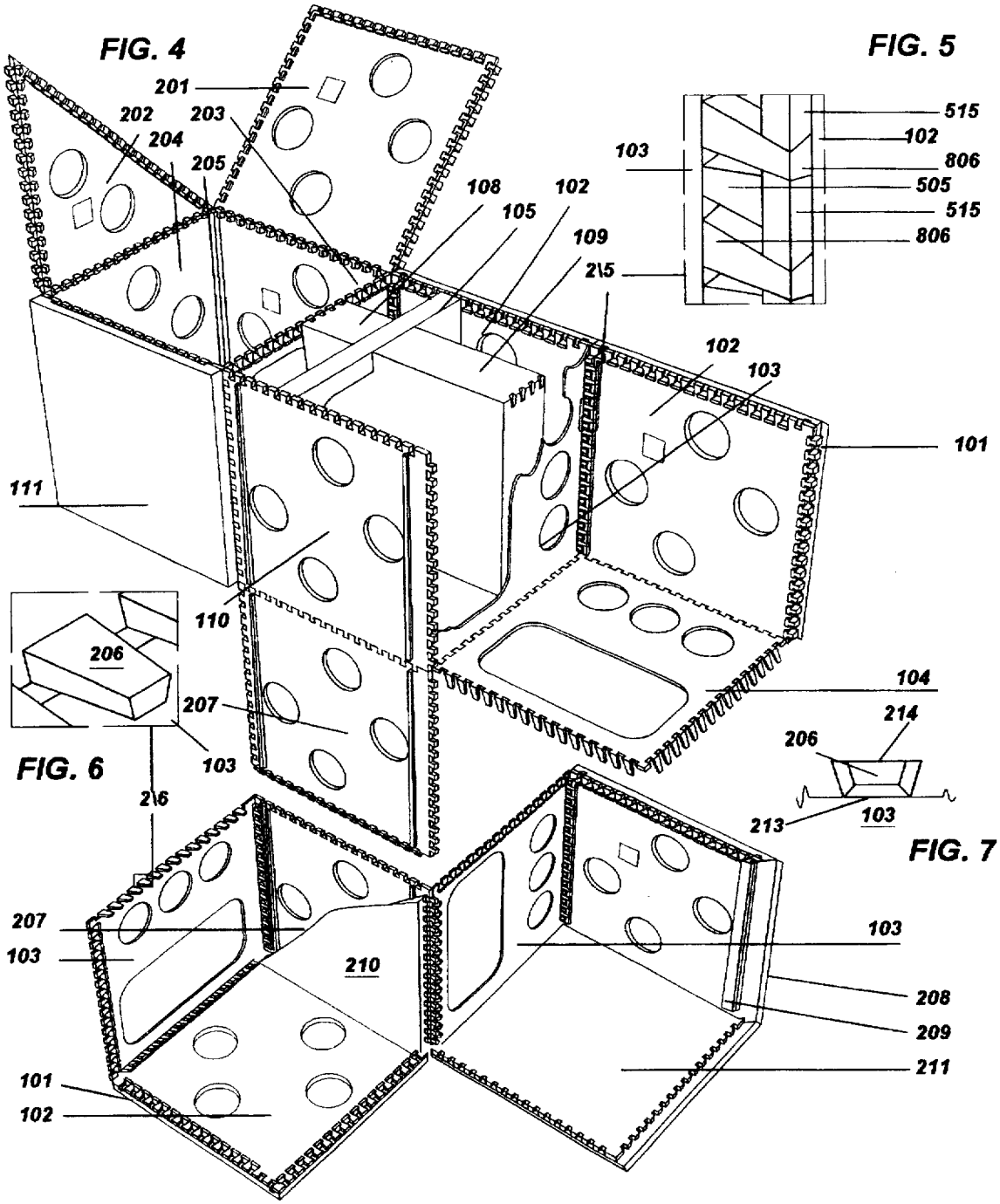
FIG. 4 is a perspective, viewed from one third of the distance of other views, of a partially assembled structure showing various structural elements including end, transitional, and special membrane shapes necessary to complete structure systems. Special shapes at openings are not illustrated. A break is indicated between foundation and upper components.
FIG. 5 shows a partial view of an inside corner between three locked membranes to illustrate dual locks necessary to prohibit three dimensional movements, prevent detachment of the assembly, and to stiffen edges.
FIG. 6 shows a view of a typical locking bolt, or tapered projection or tooth, connecting three truss membranes and providing the dual lock stiffener shown in FIG. 5.
FIG. 7 is an end view of the same locking bolt showing a truncated pyramid with the taper on three sides of an inverted trapezoid base with orthographic projection of the greater side.

FIG. 4 is shown in two groupings, perimeter parts and foundation parts, in order to show special transition parts necessary to connect parts shown FIG. 2 with those in FIG. 1 and FIG. 3. Parts 201 and 202 are varieties of part 102, providing for a transition to a slope, shown in FIG. 1. Edge modifications in 203, 204, and 209 as well as part 205 are further detailed on Sheet Five. Aforementioned Part 105 enhances structural characteristics, analyses, and longevity of the system. Parts 108 and 109 provide insulation, bracing, and secondary load support; while Parts 106 and 107 resist rotation as well as shear.

An essential part of this enhancement is the connection of exterior and interior facing units, 101 and 111 to the exterior and interior longitudinal membranes, 102 and 110 respectively. The interior facing unit, 111, is designed to carry compressive loads from interior floors and roof as well as loads transferred from the exterior facing unit, 101; while exterior facing unit 101 must resist and transfer positive and negative forces, it must also resist compressive forces from a second direction.

Since tension members are extremely thin in comparison to their size, edge stiffeners are provided in the form of locking bolts or teeth, 206, (also identified as 801, 806, and 902), which anchor into strikes (reentrant openings) at both right and left sides of parts 102 and 110 as well as their tops and bottoms. Dual locks at joints between 102 and 103 are illustrated at 2\5, (see Sheet Two, FIG. 5). Note: sheet\figure applies to graphics and sheet/total sheets applies to graphics. The end view of bolt 206 in FIG. 7 illustrates the graphic inverted trapezoid illustrated for transference of tensile stresses. The line where the tooth joins the primary body is always less than other parallel lines across the body of the tooth. Tensile forces are perpendicular to the top face and to the greater side of the trapezoid. The joining edge at 213, the opposite edge at 214, and the reentrant facet are identified.

Part 207 is a modification of part 110 with connections for changing the primary perimeter truss in FIG. 2 to an interior floor and ceiling truss in FIG. 3. When parts 101 through 111 are rotated 90° counterclockwise, they may become interior floor and roof trusses. An acute angle rotation in like manner will result in an alignment suited for roof trusses. Part 208 is also a version of part 101 while 209 is a version of 102. Modifications are indicated at the corners and at bottoms. Part 205, a corner lock, is detailed in FIG. 20. Part 211 is a special corner foundation unit. Parts 101 and 102 are companions, as are 208 and 209. Together, they form a chord of a bidirectional truss. Companions may be connected at the factory or in the field. Parts 101 through 103 have been rotated 90° counterclockwise in the foundation group in FIG. 4 as well as in FIG. 3. Part 101 may become a roof unit in FIG. 1, or a floor unit in FIG. 3, or a ground foundation unit in FIG. 4, or an exterior facing unit in Figures Two and Four. The common characteristic in all alignments of Part 101 is that each is a chord and each relays active variable live loads through Part 105 to Part 111. Conversely, 111 may be interior walls and ceilings; their commonalty being not only the attachment to Parts 110, but also to resist compressive and tensile forces.

Figure 8:
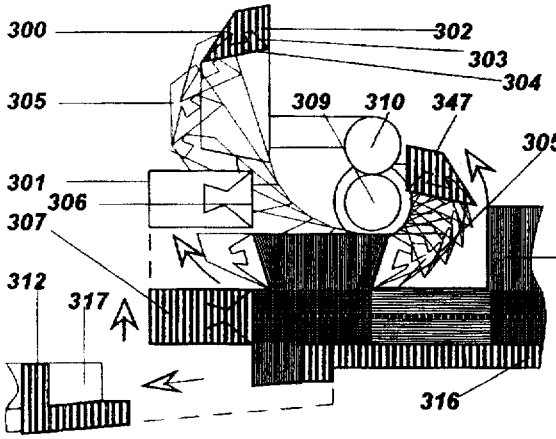
FIG. 8 shows a detail sectional view from FIG. 10 with manufacturing tool movements and tracery paths of tools necessary for product release after shaping.
Figure 9:
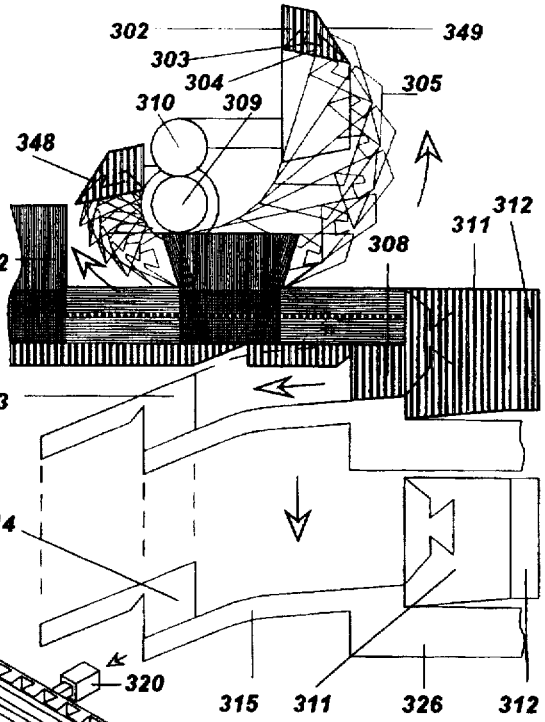
FIG. 9 is a section view of the opposite side showing differing tool movements necessary for product release.
Figure 10:
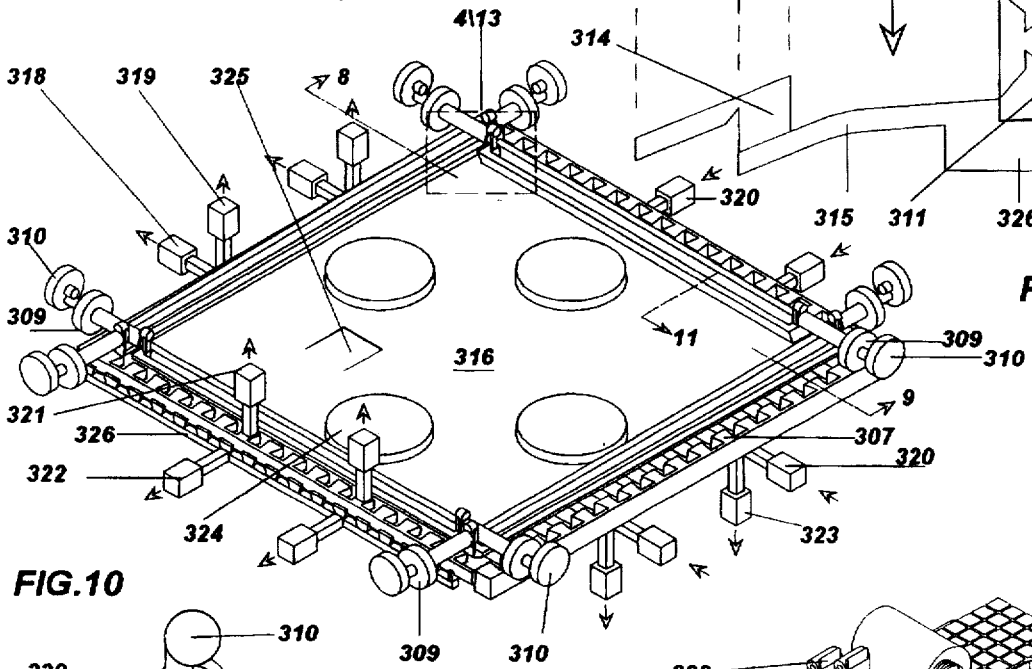
FIG. 10 shows the shaping device ready for placing fibrous media to produce the structural element shown in FIG. 18.
Figure 11:
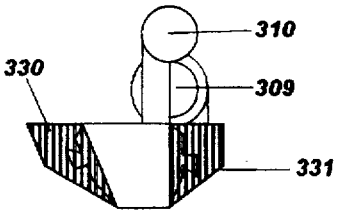
FIG. 11 shows a partial sectional view of the upper facing lock forming tools with rotors.
Figure 12:
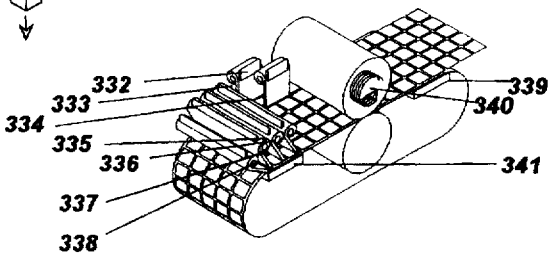
FIG. 12 shows a schematic view of manufacturing equipment needed to form five elements or parts simultaneously on a rotating assembly. Details are provided in the above referenced disclosure, "Method of Manufacture of Structural Products".
Figure 13:
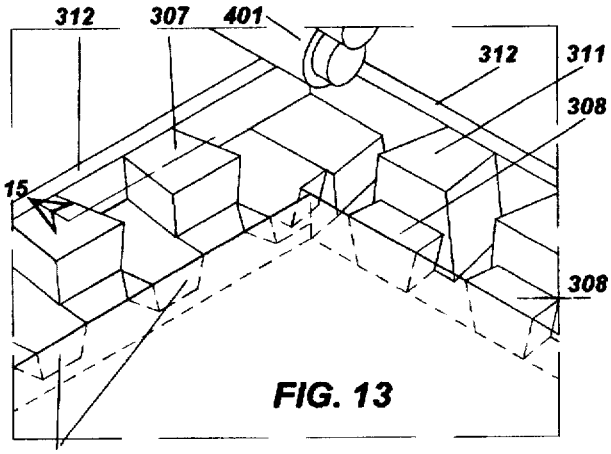
FIG. 13 is a corner detail from FIG. 10 with elevated rotors after discharging material.
Figure 14:
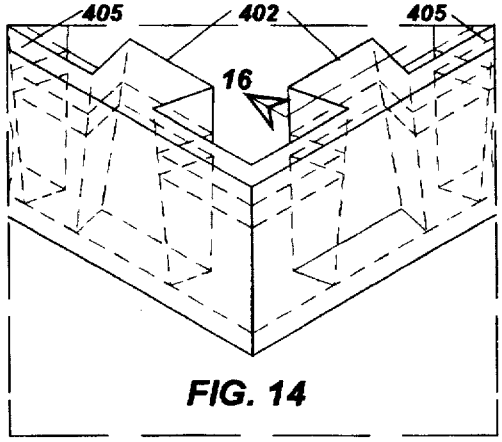
FIG. 14 is a corner detail of FIG. 17 showing shaping tools.
Figure 15:
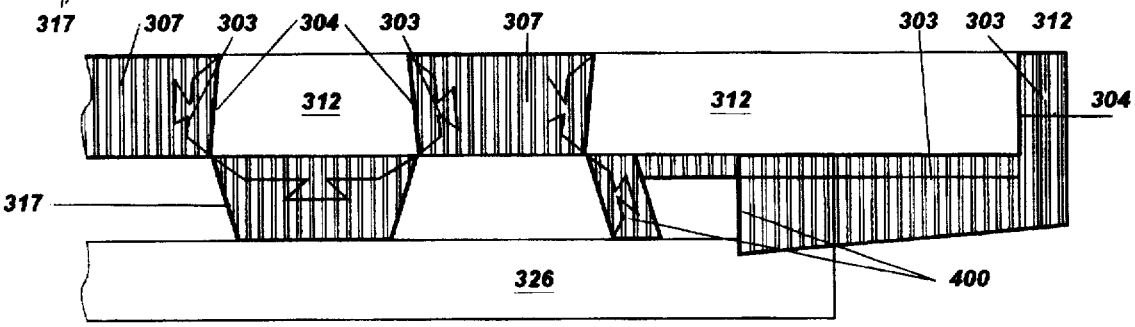
FIG. 15 is a sectional view of the shaping tools detailed in FIG. 13.
Figure 17:
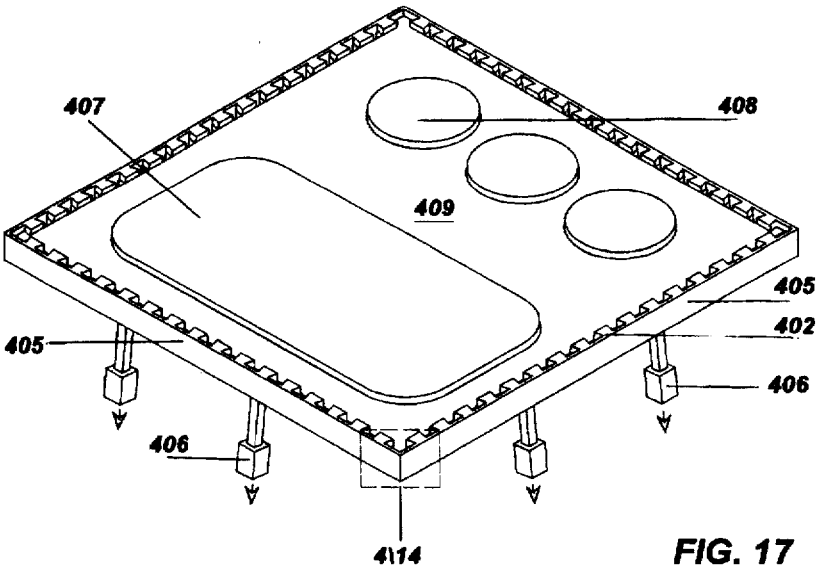
FIG. 17 contains a view of the shaping device needed to shape part 104 detailed in Sheet Nine.
Figures 18, 19, 20, 21, 22, 23:
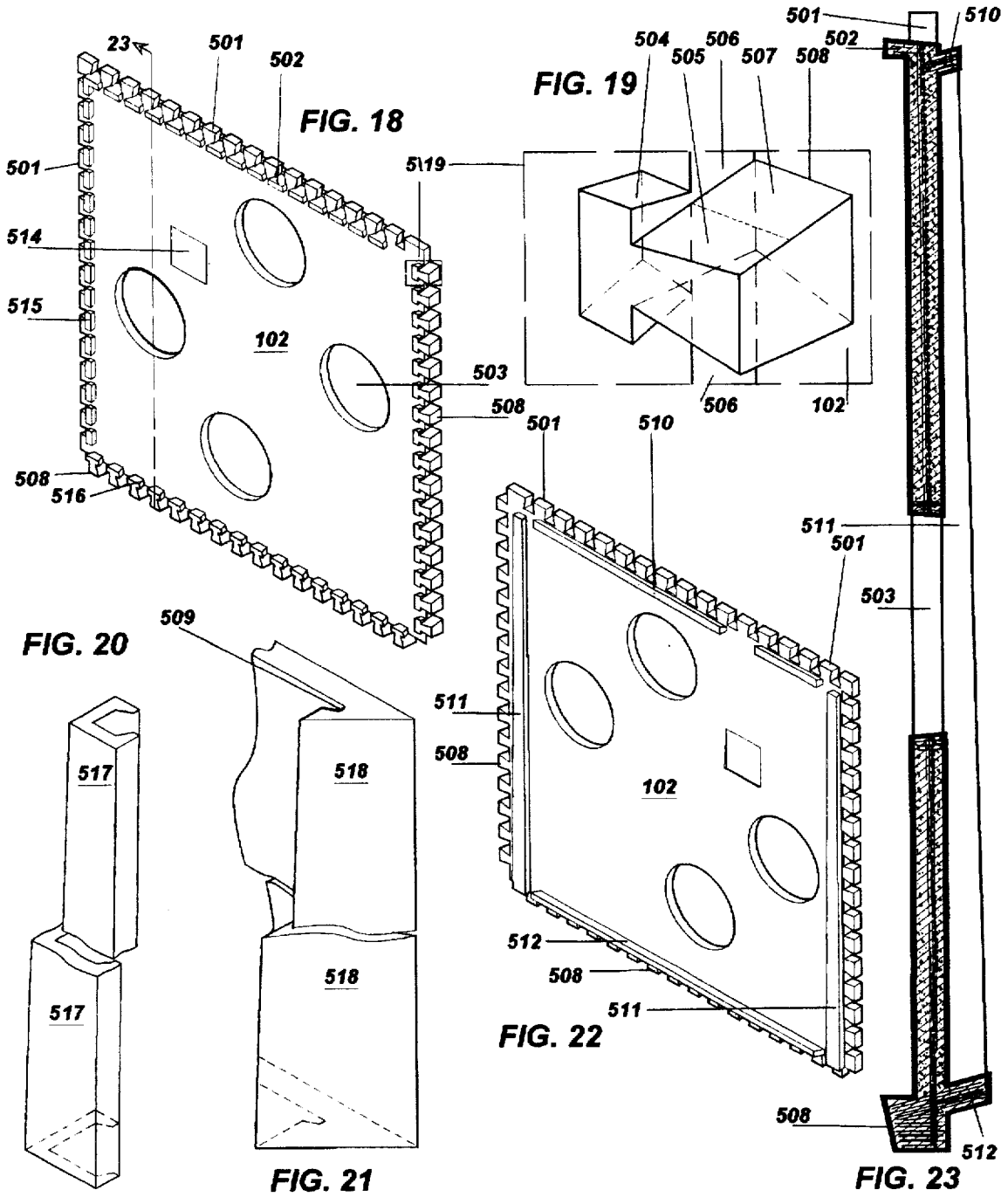
FIG. 18 shows a frontal view of a single force tensile membrane, a truss top chord member.
FIG. 19 is a detail of a combination bolt (tooth), strike and stiffener shape from FIG. 18 illustrating a means for stiffening membranes by connecting teeth.
FIG. 20 is a segmented view of a corner bracket.
FIG. 21 is a segmented view of the corner component of parts 204 and 209. It is a companion for a part detailed in FIG. 20; a mirror image part is necessary to complete a corner.
FIG. 22 shows a view of the backside of part 102. The view in FIG. 18 has been rotated 180° . Two means for rigidly interconnecting members are illustrated.
FIG. 23 is a sectional view of part 102 showing fiber reinforcement alignment and teeth.
Figure 24:
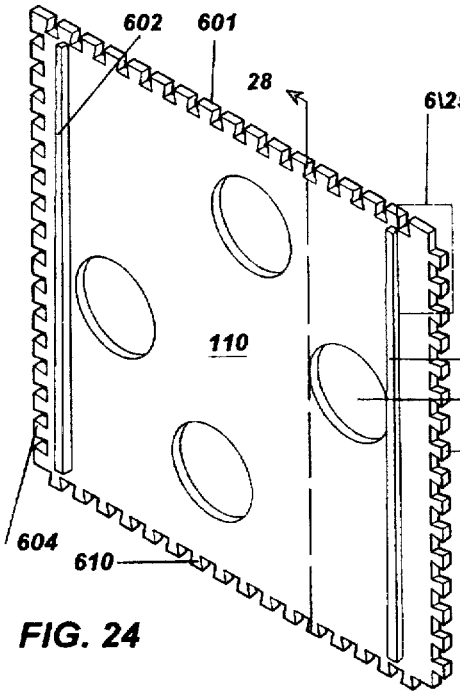
FIG. 24 shows an interior view of a bottom chord tensile membrane.

Sheets Three and Four illustrate the aforementioned method of manufacture of thin, polyhedron membranes with exacting measurements, without shrinkage or voids and from nonplastic matrix. FIG. 10 is a view of the manufacturing shaping device for Part 102 at a sequence prior to material placement. The inside face is down; the object in FIG. 18 is rotated 90° counterclockwise. FIG. 12 is a schematic of a rotary device for processing five shaping devices concurrently. Details are contained in referenced "Method of Manufacturing Structural Products". Shaping tools illustrated in FIG. 10 and FIG. 17 are continuously cycled through the material deposit, shaping, initial cure, separation, and return. Constituents are piped into the top of the aerial mixing chamber at 332; and mixed with humidity controlled air or inert gas at 333; and directed downward in a stack at 334 where alignment of particles is completed. Stacks at 334 through 338 will carry various mixtures of cements, fibers, filaments, clays, and aggregates depending on the use, market price and location. Electromagnets are schematically indicated at 339 and 341. The drum at 340 is used only on parts 101, 111 and 209 for color and finish application; computer controlled paint jet equipment may also be used here as well as an additional electromagnet. The aligning device at 332 through 338 carries a positive electrical current. Shaping tool surfaces will carry a negative electrical current and will change poles after deposit and initial set. Shaping tools represented at 300, 347, 348, and 349 are moved by hydraulic rotors indicated at 309 and 310. Pistons are indicated at 318 through 323. All tools are made up of two parts; anodes, carrying a positive electrical charge, are illustrated at 302 and cathodes, carrying a negative electrical charge, are at 304. They are separated by electric insulators at 303. All tools and connectors are comprised of anodes, cathodes, and insulators; even though not specifically illustrated or called out hereafter. Cathodes will change poles while the anode will always be the same. Movement of tools, necessary for product release, have potential conflict. Tracery paths are indicated at 305 in FIG. 8 and in FIG. 9. After initial set, tool 300 must be rotated prior to movement of part 307 to position 301 to avoid conflict at 306; the reverse operation must occur prior to the next cycle. Space has been provided to avoid conflicts between tools and product parts. A part of this configuration are tools 317 with connectors 312 which move as indicated after initial set. Tools 308 with its attached leg must be moved to the left by piston 320 without rotation until it is under the base, 316, at the position 313. It can then be moved downward along with tools 311 and connectors 312, 315 and 326 to position 314. Tools at 324 shape ventilation holes. A small indentation in the base 316 is at the position 325 to provide a wedge for transferring compressive forces. Rotation of the alignment rods and the stack, 332, will cause fibers to be arranged in a radial pattern. This is part of the stress transfer system 105 described here before. Shaping tools 330 and 331 in FIG. 11 form the upper locking teeth. Fiber alignment is indicated at 345.

Figure 16:
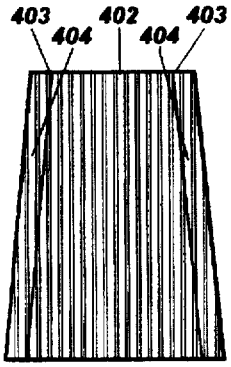
FIG. 16 details a sectional view of shaping tools shown in FIG. 14.

Sheet Four shows additional details from Sheet Three along with a sectional view of the shaping tool for the bolt indicated at 206 and the shaping device for part 104. End blocks are necessary at corners shown at 400. Position 401 indicates the rotor tools elevated in the manufacturing sequence after product separation and prior to forming the nonplastic matrix. The anode, 402, is separated from cathode, 404, by insulation 403 (FIG. 16); while 405 connects the tools to the pistons 406 (FIG. 17). Holes are formed by 407 and 408 penetrating the base cathode 409.

Figures 29, 30, 31, 32, 33, 34:
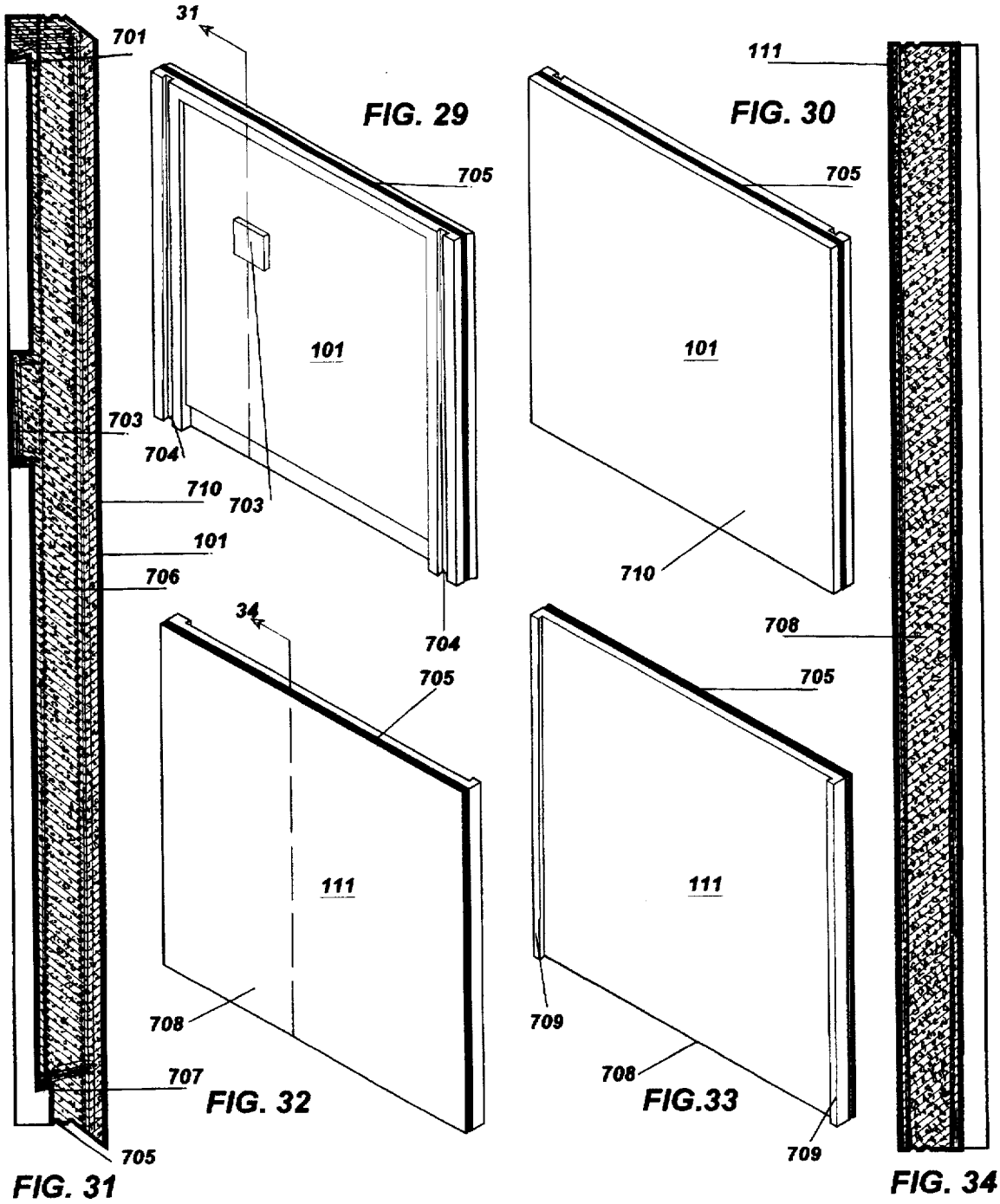
FIG. 29 is a view of the exterior facing unit, 101, a member resisting and transferring both compressive and tensile forces, and part of the top chord when assembled.
FIG. 30 is a view of its backside.
FIG. 31 is a sectional view of the top chord facing unit.
FIG. 32 is an interior view of the bottom chord facing unit, part 111.
FIG. 33 is a view of the interior facing unit shown in FIG. 32 and rotated 180°.
FIG. 34 is a sectional view of part 111, a dual force bottom chord facing member.
Figure 46:
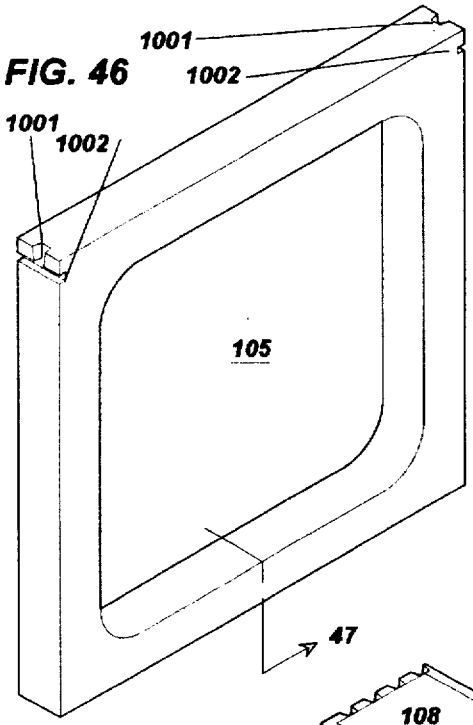
FIG. 46 is a frontal view of an anti-compression rigid frame member 105, an anti-compression member.
Figure 47:
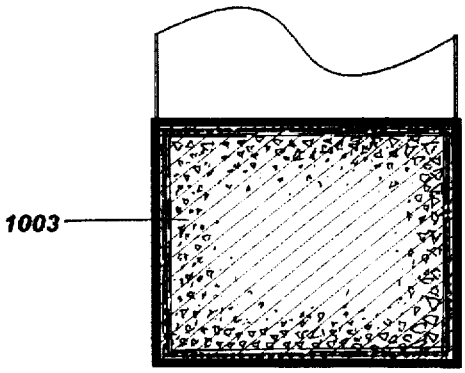
FIG. 47 shows a fragmented part of 105 in section showing aggregate and fiber alignment.
Figure 48:
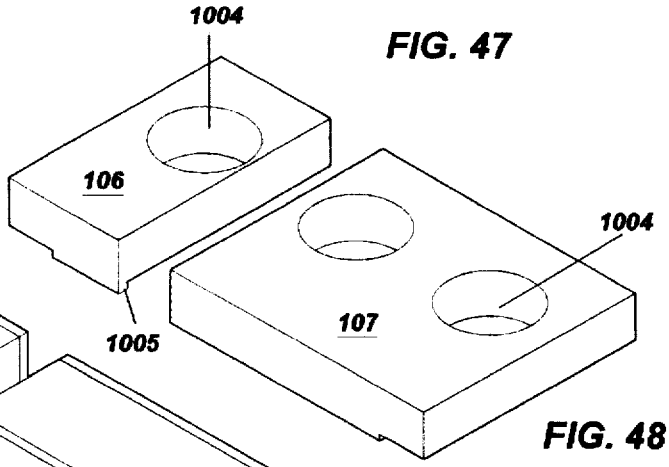
FIG. 48 shows a top view of the two piece, anti-shear and anti-flex member which is placed on both sides of part 105 It also resists compressive forces when assembled.
Figure 49:
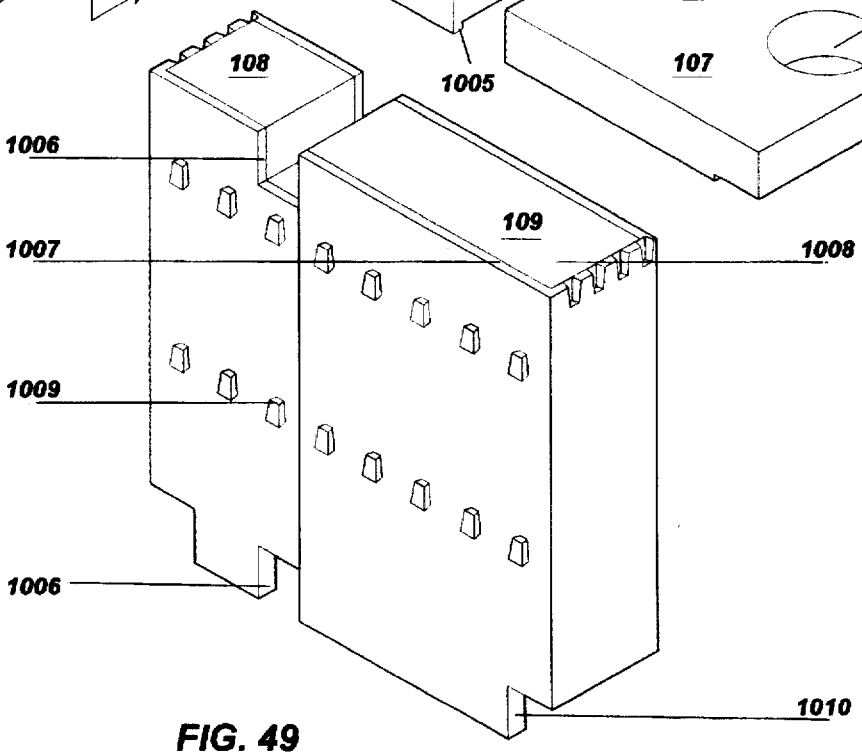
FIG. 49 is a frontal view of a two piece insulation and anti-compression member.
Figure 51:
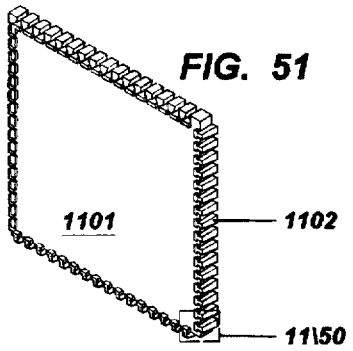
FIG. 51 is a frontal view of an alternative part which may replace both parts 101 and 102 as well as 110 and 111.

Sheet Five details tensile membrane 102, and fragmented parts of 204, and 209. Tensile forces are transferred from one member to another member by a system of bolts (teeth) and strikes (reentrant spaces defined by teeth) to form locks which prevent the membranes from becoming detached due to twisting or rotational forces. The reentrant face for bolts (teeth) is identified at 501; strikes (reentrant spaces defined by teeth) are formed at the top and left for bolts at 508, at the bottom and right. Bolts, 902, (FIG. 41) will lock when stopped by strikes 502 and 516; bolts, 806, (FIG. 35) will lock when stopped by strikes 504 and 515. Stiffeners 505 connect teeth at 504 with bolt 507 to form a complex shape 508 and provide additional edge rigidity. The portions, 505 and 507, are similar to the larger ends of 216. Bolts—501, 502, 504, 508, 510, and 512—all have a common characteristic. Each have facets which meet the primary body at obtuse angles indicated at 520 and 612. The distance between these facets at the juncture with the primary body is less than at any respective line at a parallel section, or opposite edge. When a negative or tensile force is applied to two interconnected membranes, the transfer is by tension through fibers aligned parallel to the tensile force and the polyhedron primary face. Ventilation openings at 503 are necessary to prevent heat failures due to fire, and provide for design of two-hour and four-hour fire resistive systems referenced in many local codes. The primary body of the top chord membrane, 102, is between the teeth at 501 and 508 (vertical) and between 501 and body edge at 506 (horizontal). The reentrant face is identified at 501. The reentrant spaces (strikes) between the teeth accept the bolt, 508. A strike (teeth creating reentrant spaces) is formed at 509 for part 517; 510 locks into 701 (FIG. 31); 511 locks into 704 (FIG. 29); and 512 locks into 707 (FIG. 31). The corner lock, 517, (also see 205 in FIG. 4) holds two longitudinal chord membranes in a rigid connection. One of the two parts is shown at 518, a corner variation for parts 204 and 209. All four edges of exterior longitudinal membranes are locked into the companion facing unit to counteract negative stresses. When the two components, 101 and 102 are assembled, they act as top chords of a truss; however, membrane 101 is protected from compressive forces. Compression transfers at 514 from the companion top chord member, 101, through 105 into the bottom chord member 111.

Figure 25:
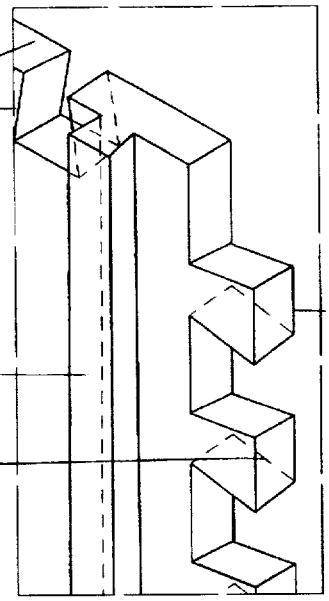
FIG. 25 is a corner detail from FIG. 23.
Figure 26:
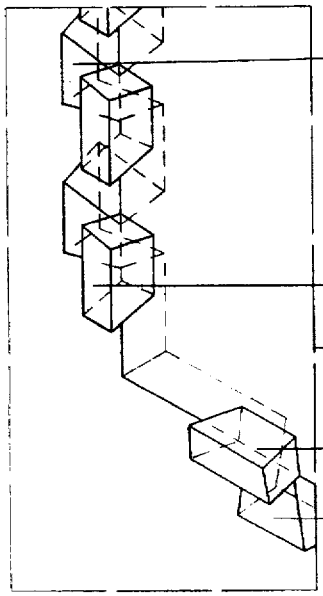
FIG. 26 is a corner detail of the back side of part 110.
Figure 27:
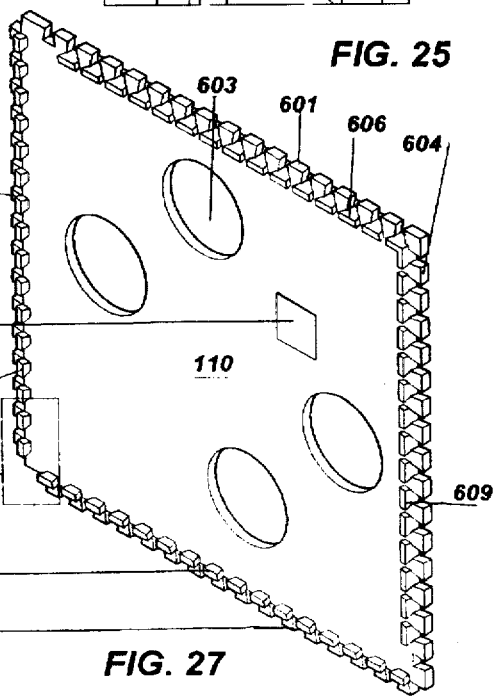
FIG. 27 is a view of the back of part 110 where FIG. 24 has been rotated 180° illustrating teeth projecting parallel as well as perpendicular to the primary face of a polyhedron membrane.
Figure 28:
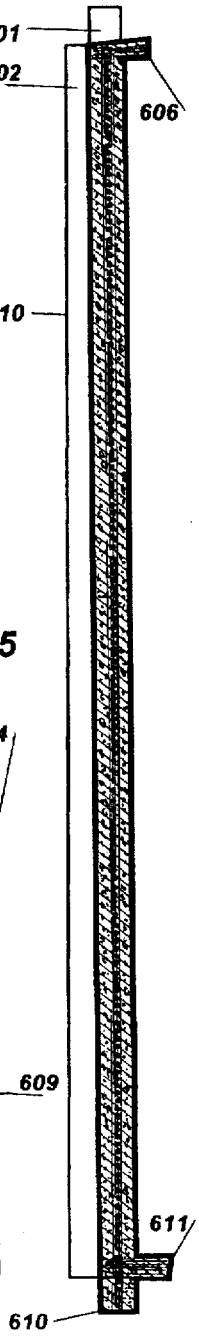
FIG. 28 is a sectional view of the same part showing fiber alignment and teeth.

Sheet Six details a bottom web membrane, tensile member 110, companion to the bottom chord 111. Each view may be a mirror image of the parallel part 102; however, since stresses differ, details differ and stiffeners 505 have been omitted. The reentrant faces of bolts (teeth) 601 and 604 are identified in FIG. 27. Strikes (reentrant spaces) formed by 601 and 604 stop bolts (referred to as teeth in the claims) at 610 and 605 respectively. The bolts illustrated in Sheet 6 are similar to those in Sheet 5 (501, 502, 504, 508, 510). Bolts 602 lock into strikes formed by 709 (FIG. 33) when facing unit 111 is dropped downward when the two companion parts are in alignment. Parts 110 and 111 act as bottom chord members; however part 110 is protected from compressive forces. Ventilation holes at 603 correspond to 503. Strikes formed by 606 and 611 stop bolts 902, while strikes (reentrant spaces) formed by 608 and 609 stop bolts 801. Compression transfer from 105 to 111 is at 607. Facets at 612 meet the primary body, 110, at obtuse angles. The obtuse angles are also indicated in FIG. 25. The tooth faces in view are larger than the opposite reentrant face. All bolts (teeth) illustrated in sheets one through nine have this commonality.

Sheet Seven contains views of facing units which are top and bottom chords. The exterior facing unit in FIG. 29 must transfer large negative stresses caused by high winds when exposed as roof and exterior walls. When part 101 is in final alignment with part 102, the top angle bolt at 701 is stopped by 510; 707 is stopped by 512; bolts 511 are stopped by strikes (reentrant spaces) 704; thus providing negative stress transfer and stiffeners at all four edges. Compression transfer block 703 completes the stress transfer into part 105. This compression block forms a wedge between parts 101 and 102. Considerable force must be exerted downward on parts 101 during assembly to effect this connection, causing deformation of 101. Continuous grooves, 705, at all four edges provide for installation of "O" rings for water and vapor stops. The main body, 706, of the exterior facing unit may be a composite of several layered materials with insulation for fire resistance. The main body of 111, indicated at 708, is a compression resistant material such as basalt, zirconium silicate glass fibers and calcium aluminate cement, or alumina fireclay with carbon or boron fibers. Dependent on the market, expanded ceramics may be one of the layered materials. Teeth at 709 attach part 111 to part 110 and transfer stresses from 110 into 111. Optional finishes are indicated at 710.

Sheet Eight details tensile member, part 103, a first web member of a truss. Bolts at 801 are stopped by strikes (reentrant spaces) at 608 and 609, while bolts at 806 are stopped by 504 and 515, and bottom bolts at 803 are stopped by 802. Strikes (reentrant spaces) at 804 and 805 stop bolts at 902. Strikes 805 are omitted where adjacent to 108 and 109. Ventilation holes are provided at 807 and utility access is provided at 809. FIG. 38 shows an assembled detail at a corner between parts 102 and 103 where teeth of web membrane 102 interlock with teeth of two adjacent aligned chord membranes 103 and interlock with teeth of two other adjacent aligned web membranes 102, thereby forming joins of groups of three and forming hollow polyhedron shaped and aligned box trusses as illustrated in FIG. 1–4.

Sheet Nine illustrates a second web truss member 104. Ventilation holes are provided at 901 and utility access is provided at 903. Bolts on the four edges, noted at 902, are stopped by strikes (teeth creating reentrant spaces) on parts 102, 103 and 110. Connections with Part 103 occur at 906 and the opposite edge; while connection with 102 is at 907 and the opposite edge at 908 is with 110. Alignment bars are provided at 904. Details are indicated at 9\42 and 9\43; the first number, 9, being the sheet number and the second being the figure number. This member may be referred to as the cap member, as it completes a sequence in the assembly process where a six-sided, box truss is completed.

Sheet Ten shows views of core members. A compression and shear member, 105, has cutouts for a bolt, 902, at 1001 and strikes, 606 (left) and 5O2 (right), at 1002. The cutouts hold the unit in correct alignment. When installed this part forces tensile stresses upon membranes, 102, 103, 104, and 110. It is fabricated from a mixture of basalt or hard aggregates, fibers and hydraulic cement as noted at 1003. Parts 108 and 109 must be installed in two segments. They anchor parts 105 at 1006; parts 106 and 107 are also anchored at 1010. Parts 108 and 109 act as an insulator as well as a secondary compression member in the event the interior compression member, 111, is damaged by fire or mechanical accidents. The enclosure at 1007 is basalt aggregate, fibers, hydraulic cement, while the center portion, 1008, may be foam glass, structural urethane, and other materials. Utility holders are indicated at 1009. Parts 108 and 109 block movement of parts 106 and 107 at 1010. Parts 106 and 107 are shear members necessary for large spans. Parts 106 and 107 contain ventilation holes at 1004 which align with holes in part 104. It is placed in two segments on both sides of part 105 noted at 1005 and before 108 and 109 are positioned. The protrusion at 1005 aligns with the edge of the utility access opening in part 104.

Assembly of parts are from right to left when viewed from the inside and as illustrated herein. The bottom foundation unit is started at a corner as noted at 211 (Sheet 2). Work proceeds toward the left in horizontal courses or wythes. The entire foundation perimeter wythe and the next wythe should be completed before interior work (a floor assembly is illustrated in FIG. 3) is started. Four longitudinal membranes, or top chords, are positioned with Parts 102 opposite Parts 110 and with Part 103, the first web member, in position to engage strikes 504 and 608. Part 103 will then be shoved home into a locked position. Detachment of previous work is not possible when this part is installed. Part 104 should be positioned prior to locking the second web 103. When it is locked, part 104 can be dropped and locked. Core parts 105, 106, 107, 108 and 109 are then positioned (in numerical order) and one wythe may be finished and utilities may be installed before starting a second wythe. The previous step is repeated where two Parts 102 and 110 are locked into position by two parts 103 and core parts 105 through 109 are installed. Then part 104 may again be dropped into position, capping a completed bi-directional box truss, and providing a means to tie two wythes and distribute forces between wythes. At least two wythes should be in place before installing 101 in order to avoid difficulties in positioning 103, 104 and 105. Parts 111 may be installed with each wythe. Transitional members, indicated on Sheet 2, are installed where applicable and interior work may be completed.

Figure 50:
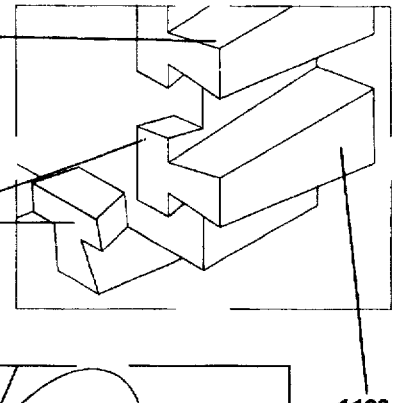
FIG. 50 is a corner detail from the part shown in FIG. 51.
Figure 52:
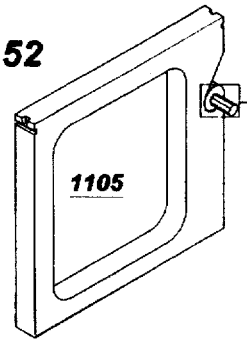
FIG. 52 is a view of an alternative to part 105. The offset cam illustrated can be turned to further separate top and bottom chord membranes. Stops are provided to hold members apart.
Figure 53:
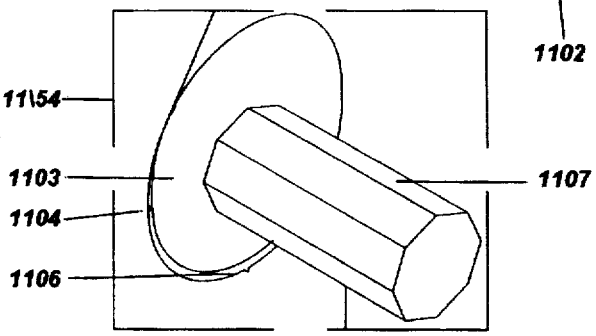
FIG. 53 shows a detail of another alternative part.

Sheet 11 shows alternatives to that shown in previous sheets. In a version of 102, also applicable to 110, unit 1101 is designed as both a compression as well as a tension member. Edges are thickened at 1102; 11\50 designates FIG. 50 on Sheet 11. In FIG. 52 alternative 1105 to part 105 indicates an offset cam located on the side adjacent to 102. It has a handle at 1107 and protrusion 1104 which stops rotation at notch 1106. When rotated, force is exerted against parts 102 and 110 to force them apart.

Figure 55:
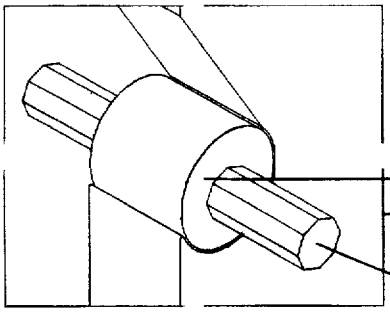
FIG. 55 is a view of a second alternative to part 105. The cam has been moved to a more accessible location.
Figure 54:
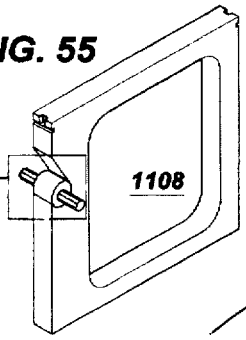
FIG. 54 is a detail view of the offset cam in FIG. 52.
Figure 57:
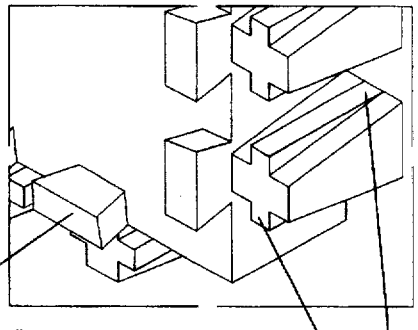
FIG. 57 details a corner of the alternative part shown in FIG. 56.
Figure 56:
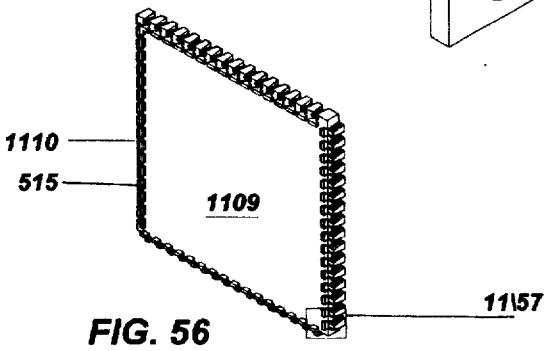
FIG. 56 is a view of another alternative to parts 101 and 102 as well as 110 and 111.
Figure 58:
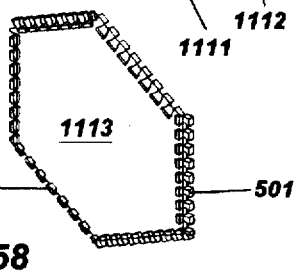
FIG. 58 illustrates an alternative chord member of a truss with two parallel regular hexagon faces.

When the cam is located at the opposite side as in 1108, FIG. 55, force is exerted against part 110. Another alternative to bolt 206 substitutes a rectangle for a trapezoid as indicated in FIG. 56 and FIG. 57 and noted at 1112. A tongue, 1111, is incorporated in the bolt to prevent movement parallel to the alternative member indicated as 1109. The strike is on the opposite edge at 1110. This alternative would result in a shearing action and would severely reduce the strength. The component 1113 is an alternative shape to parts 102 and 110 in Sheet 5. This part has six transverse faces with teeth along the edges of the primary face and the edge surfaces in the same manner as parts 102 and 110. When assembled, this would form trusses resembling a honeycomb.

I claim:

1. A structure for use in structural, load bearing construction, comprising:

Interlocking box trusses consisting of core members held by web membranes and pairs of parallel spaced chord membranes, and facing units, each of said web membranes and each of chord membranes of said pairs of parallel spaced chord membranes having at least one major axis, upper and lower transverse edge faces, side transverse edge faces, opposing primary faces, and edges, each of said web membranes and each of chord membranes of said pairs of parallel spaced chord membranes having a plurality of alternating, tapering, and projecting teeth and transverse strikes on said transverse edge faces and at least one of said primary faces thereof, each said teeth having a shape of a truncated pyramid with a taper on three sides of an inverted trapezoid base and with orthographic projection of a greater side, and having facets joined with at least one primary face at obtuse angles, a distance between said facets at the juncture with said primary face being less than at other respective facets, wherein said web membranes are aligned perpendicular to said parallel spaced chord membranes;

each of said chord membranes of said pairs of parallel spaced chord membranes being aligned and interconnected with respective chord membranes of adjacent box trusses, said web membranes interlocking with pairs of interconnected said parallel spaced chord membranes at said upper and lower transverse edge faces and with pairs of other interconnected web membranes of adjacent aligned box trusses at said side transverse edge faces, wherein said facing units are deformed by wedges between said facing units and anti-compression rigid frame core members; and said teeth of web membranes interlocking with teeth of two adjacent aligned chord membranes and interlocking with teeth of two other adjacent aligned web membranes, thereby forming joins of groups of three and forming hollow polyhedron shaped and aligned box trusses.

2. The structure according to claim 1, wherein each of said box trusses are comprised of four web membranes and two parallel spaced cord membranes, and said web membranes are perpendicular to each other.

3. The structure according to claim 1, wherein said web membranes and said chord membranes are fabricated of cement and fibers and filaments in selected alignments, and said core members and said facing units are fabricated of cement, fibers, filaments, aggregates, and insulating materials.

4. The structure according to claim 1, wherein each of said web membranes, said chord membranes, and said projecting teeth and strikes thereof are formed by shaping devices including a base on a rotating assembly consisting of hydraulic rotors and pistons, and tools including anodes and cathodes separated by electric insulators.

* * * * *